US007886804B2

(12) United States Patent
Goodman et al.

(10) Patent No.: US 7,886,804 B2
(45) Date of Patent: Feb. 15, 2011

(54) FOLDING PARTITIONS, COMPONENTS THEREFOR AND RELATED METHODS

(75) Inventors: E. Carl Goodman, Bountiful, UT (US); Michael D. George, Kaysville, UT (US); Michael E. Hazlett, Salt Lake City, UT (US); Craig G. Bell, South Jordan, UT (US); Ronald A. Smart, Sandy, UT (US); Jaren R. Dickinson, Kearns, UT (US)

(73) Assignee: Won-Door Corporation, Salt Lake City, UT (US)

( * ) Notice: Subject to any disclaimer, the term of this patent is extended or adjusted under 35 U.S.C. 154(b) by 0 days.

(21) Appl. No.: 12/023,001

(22) Filed: Jan. 30, 2008

(65) Prior Publication Data

US 2009/0188633 A1 Jul. 30, 2009

(51) Int. Cl.

| | |
|---|---|
| ***A47H 5/00*** | (2006.01) |
| ***E06B 3/48*** | (2006.01) |
| ***E06B 3/94*** | (2006.01) |
| ***E06B 9/06*** | (2006.01) |
| ***E05D 15/26*** | (2006.01) |

(52) U.S. Cl. ..... 160/199; 160/84.08

(58) Field of Classification Search ..... 160/107, 160/113, 126, 168.1 V, 170.1 V, 199, 206, 160/229.1, 84.08, 89; 181/224, 264; 454/195, 454/185, 206, 238

See application file for complete search history.

(56) References Cited

U.S. PATENT DOCUMENTS

| | | | | |
|---|---|---|---|---|
| 3,082,817 | A * | 3/1963 | Merrill | 160/40 |
| 3,447,584 | A | 6/1969 | Smart | |
| 3,481,388 | A * | 12/1969 | Smart | 160/84.08 |
| 3,850,223 | A * | 11/1974 | Tompkins | 160/84.08 |
| 3,963,094 | A * | 6/1976 | Nowikas | 181/198 |
| 4,763,712 | A * | 8/1988 | van der Klaauw | 160/84.08 |
| 4,763,714 | A * | 8/1988 | Williams | 160/200 |
| 4,924,929 | A * | 5/1990 | Johnson et al. | 160/84.08 |
| 6,609,590 | B2 * | 8/2003 | Zelinski | 181/281 |
| 6,662,848 | B2 | 12/2003 | Goodman et al. | |
| 2007/0161345 | A1 * | 7/2007 | Chato | 454/196 |
| 2007/0294945 | A1 | 12/2007 | Coleman et al. | |

OTHER PUBLICATIONS

Definition of adjacent, taken from Merriam-Webster online dictionary; 2009 http://www.merriam-webster.com/dictionary/adjacent.*

* cited by examiner

*Primary Examiner*—Katherine W Mitchell
*Assistant Examiner*—Jeremy C Ramsey
(74) *Attorney, Agent, or Firm*—TraskBritt

(57) ABSTRACT

Folding partitions and related methods and components are provided and may include accordion-style folding doors or partitions having multiple folding panels. In one embodiment, a folding partition includes one or more baffling devices. A baffling device may include an elongated enclosure having a first opening proximate a first longitudinal end of the elongated enclosure, a second opening proximate a second longitudinal end of the elongated enclosure, and a flow path extending from the first opening to the second opening. A sound attenuation chamber may be disposed adjacent at least a portion of the flow path. In one embodiment, one or more baffling devices may be disposed in, or otherwise associated with, a jamb component of the partition. In another embodiment, one or more baffling devices may be disposed in, or otherwise associated with, the hinged connection of panel sections of a partition panel.

22 Claims, 8 Drawing Sheets

FOLDING PARTITIONS, COMPONENTS THEREFOR AND RELATED METHODS

TECHNICAL FIELD

The present invention relates generally to movable partitions and more particularly to folding partitions having components to enable air-mass transfer and provide sound insulation.

BACKGROUND

Movable partitions, such as folding doors are often implemented in various settings, such as in hotels, convention centers, schools, churches and other buildings, to subdivide a single large room into two or more smaller rooms. For example, referring to FIG. 1, a prior art version of an accordion-style folding partition 100 is shown. The folding partition 100 includes two panels 102A and 102B connected, at longitudinal ends thereof; to a lead post 104. Each panel 102A and 102B includes a plurality of panel sections 106, which are hingedly connected together with hinges 108, or similar folding or hinge-like structures. The hinged connection of the panel sections 106 allows the partition 100 to be compactly stored in a plicated or accordion manner when in a compacted or folded state. When the partition is required to be opened or closed, the partition 100 may be motivated along a track 110 by an electric motor or other drive mechanism, or manually by a user pulling or pushing the partition 100 along the track 110.

Between the two panels 102A and 102B is a space that may be termed an air space 112 and which may work together with the panels 102A and 102B to provide a sound barrier. Such a sound barrier is often desired when two areas or rooms, having been subdivided by the folding partition 100, are used at the same time for different classes, meetings or other functions to eliminate or reduce the amount of noise that may enter one room from an adjacent room.

The air space 112 between the two panels 102A and 102B is conventionally maintained as a relatively static environment. In other words, while not being completely sealed relative to the environment being subdivided by the partition 100, the partition 100 is constructed to substantially limit air movement from one side of the partition 100 to the other side of the partition 100 when in a deployed or extended state. The limitation of airflow across the partition 100 is beneficial from a sound insulation standpoint as it also limits the path of potential sound waves across a deployed partition 100.

Thus, while the existence of an air space 112 is beneficial in a number of ways, the construction of the partition 100 to limit airflow when the partition 100 is deployed presents some difficulties when extending or retracting the partition 100. For example, when the partition 100 is being retracted for storage, a substantial amount of air contained in the air space 112 needs to be discharged in order to enable the partition 100 to fold or collapse. Likewise, air needs to be drawn into the air space 112 when the partition 100 is extended to a closed position. In other words, the air space 112 or the volume between the two panels 102A and 102B increases when the partition 100 is deployed and decreases when the partition 100 is retracted.

If the partition 100 is substantially sealed relative to the air space 112, the air contained in the air space 112 is unable to easily escape from between the partition panels 102A and 102B (or be drawn therein) during operation. Thus, as the partition is being retracted, the air in the air space 112 compresses and acts as an air cushion, providing resistance to the retraction of the partition 100. Additionally, in seeking an outlet, the air within the air space 112 may cause the panels 102A and 102B (and particularly the bottom 114 of each panel 102A and 102B in most conventional partitions 100) to billow out away from one another, making it more difficult to operate the partition 100 and store the partition 100 in an associated pocket.

In an attempt to release air from between the panels 102A and 102B during operation of the partition 100, some partitions 100 have included openings or holes in the lead post 104 of the partition 100. However, such a configuration does not always provide sufficient air release depending, for example, on the size of the partition 100, the spacing of the panels 102A and 102B, and the speed at which the partition 100 is closed. Additionally, in some embodiments, an operator may displace the door by pushing or pulling the lead post 104 (or some other structure such as a handle located adjacent the lead post 104). In such a situation, there is the possibility of blowing debris into the operator's face. Furthermore, if openings are formed along both sides of the lead post 104, the ability of the partition 100 to act as a sound barrier or a fire barrier may be substantially compromised.

Some attempts have been made to provide an air release structure that releases air from the air space 112 through a location other than the lead post 104 while channeling air away from the user and without providing a path for sound to easily pass from one side of the extended partition 100 to the other. For example, in U.S. Pat. No. 3,447,584 to Smart, an air release construction for a folding door is provided comprising an overhead track unit incorporating an air-release chamber therein. Air passages are provided between the door chamber or air space and an overhead track air-release chamber so as to allow air to move between the two chambers. Thus, air flows to or from the air space, through the air-release chamber, and out to the environment surrounding the door during the closing or extension thereof. Air flows in a reversed path during the opening or the retraction of the door.

While the configuration described by Smart appears to provide some airflow from a chamber or air space between panels and an exterior location, such a configuration appears to be somewhat limited in that, when initially opening the door to place it back in a stored condition, a substantial amount of air may enter into the overhead track air-release chamber but only a limited amount of air may be released therefrom due to the limited number of air passages in the overhead chamber that are exposed to an external environment. In other words, the number of passages that are exposed to the external environment when the door is in such a condition is substantially limited, but the number of passages exposed to the door chamber or air space are relatively numerous. Additionally, the converse is true when initially displacing the door to position it in an extended or closed position.

BRIEF SUMMARY OF THE INVENTION

Various embodiments of the present invention are directed toward a device for releasing air from between two panels of a dual-panel folding partition while maintaining sound insulation properties of the dual-panel folding partition.

In accordance with one embodiment of the present invention, a folding partition is provided. The folding partition includes a first folding panel having a plurality of panel sections, wherein each panel section is hingedly coupled with an adjacent panel section, and a second folding panel having a plurality of panel sections, wherein each panel section is hingedly coupled with an adjacent panel section. The first folding panel and the second folding panel are laterally spaced from, and substantially parallel to, one another. At least one baffling device is disposed adjacent at least one panel section of at least one of the first folding panel and the second folding panel. The at least one baffling device includes an elongated enclosure having a first opening, a second opening and a flow path between the first opening and the second opening. A sound attenuation chamber is disposed adjacent at least a portion of the flow path.

In accordance with another embodiment of the present invention, a method of operating a foldable partition is provided. The method includes providing a foldable partition having a first panel with a plurality of hingedly coupled panel sections and a second panel with a plurality of hingedly coupled panel sections, the first panel and the second panel being laterally spaced from and substantially parallel to one another. At least one baffling device is associated with the first panel, wherein the at least one baffling device includes a flow path from a location on a first side of the first panel to a second, opposing side of the first panel. The at least one baffling device also includes a sound attenuation chamber disposed adjacent to at least a portion of the flow path. The foldable partition is displaced from a substantially extended state to a substantially collapsed state and air is passed through the flow path from a location between the first panel and the second panel while the foldable partition is being displaced from the substantially extended state to the substantially collapsed state.

In accordance with yet another embodiment of the present invention, a baffling device is provided. The baffling device includes an elongated enclosure having a first opening formed in a first surface and proximate a first longitudinal end of the elongated enclosure and a second opening formed in a second surface and proximate a second end of the elongated enclosure. A flow path extends from the first opening to the second opening. A sound attenuation chamber is disposed adjacent at least a portion of the flow path and includes an insulative material disposed therein. A perforated member is disposed between, and partially defines, the flow path and the sound attenuation chamber.

Other features and advantages of the present invention will become apparent in the following detailed description of the preferred embodiments of the invention taken in conjunction with the accompanying drawings and examples.

DETAILED DESCRIPTION OF THE INVENTION

In the following detailed description, reference is made to the accompanying drawings which form a part hereof and in which is shown, by way of illustration, examples of practicing certain embodiments of the invention. These embodiments are described in sufficient detail to enable those of ordinary skill in the art to practice the invention. It should be understood, however, that the detailed description and the specific examples are given by way of illustration only and not by way of limitation. From this disclosure, various substitutions, modifications, additions rearrangements, or combinations thereof within the scope of the present invention may be made and will become apparent to those skilled in the art.

In accordance with certain embodiments of the present invention, air release devices for a dual-panel folding partition are provided. For example, a baffling device may include a sound baffle that diffuses or attenuates sound waves passing through the baffling device while enabling the air to pass substantially unimpeded. Related methods and systems are also provided herein.

Figure 1:
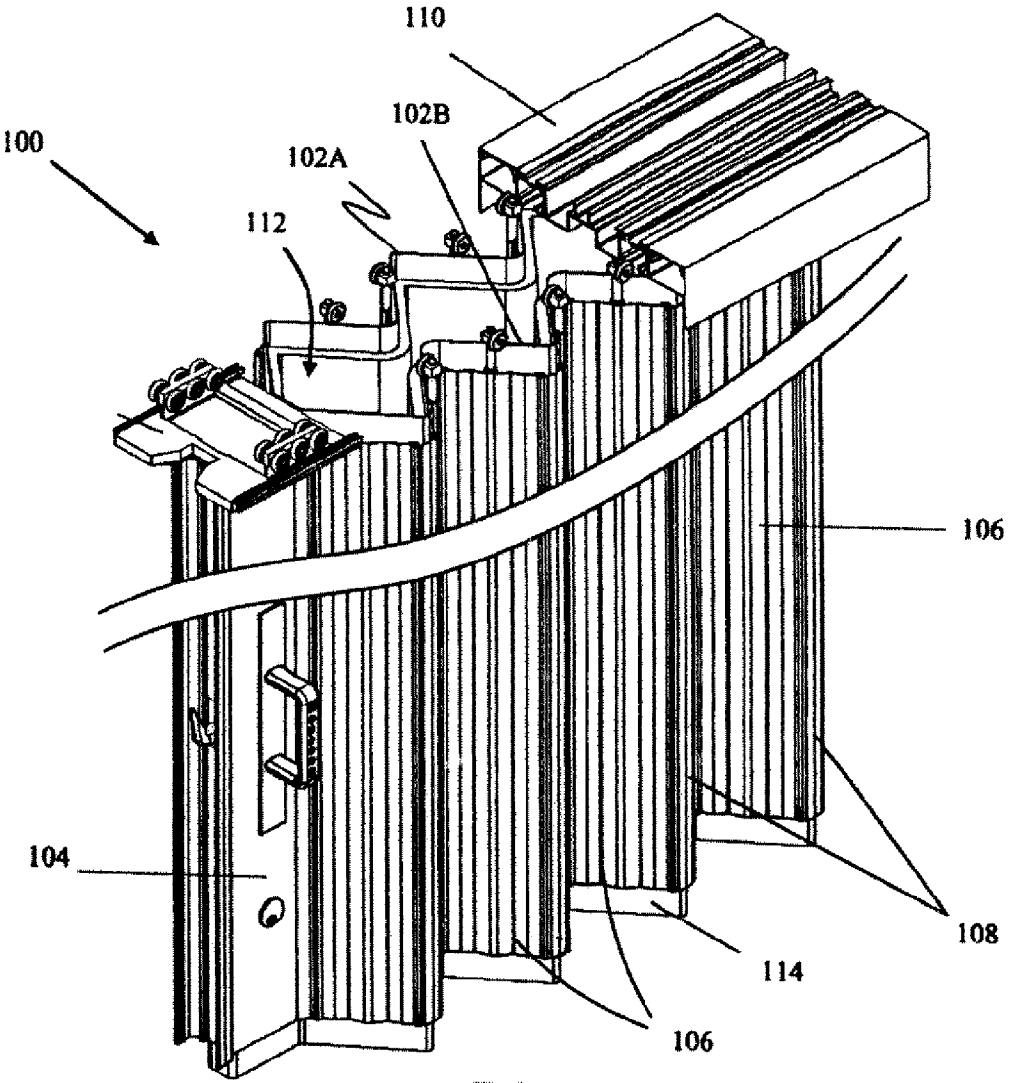
FIG. 1 (Prior Art)
FIG. 1 is a perspective view of an accordion folding partition known in the prior art.
Figure 2:
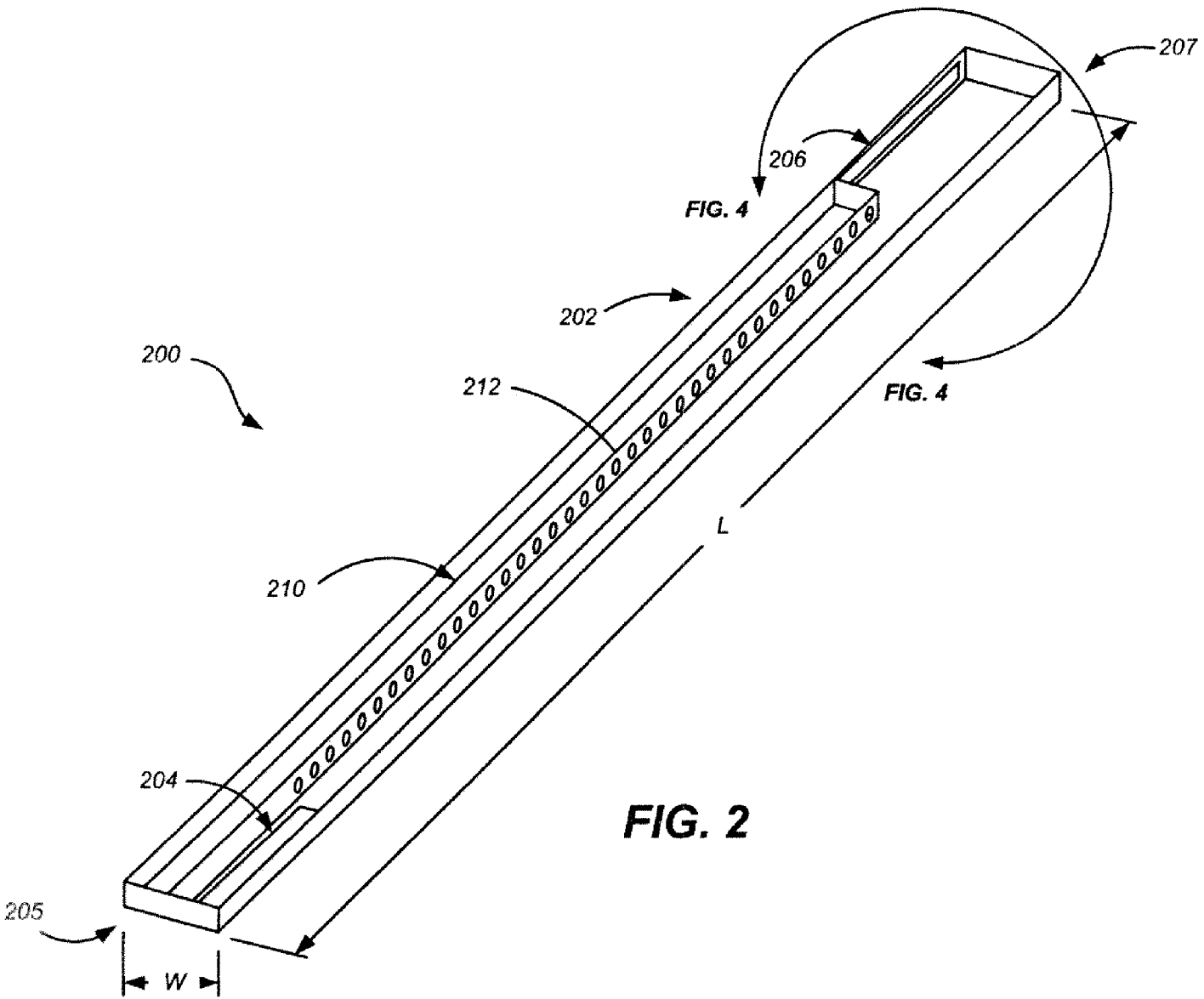
FIG. 2 is a perspective view of a baffling device in accordance with an embodiment of the present invention.

Referring to FIG. 2, a perspective view of an embodiment of a baffling device 200 is illustrated. The baffling device 200 may serve as a component of a system used to release air from between two laterally spaced partitions. The baffling device 200 may also serve as a sound attenuating device associated with such partitions as will be discussed in further detail hereinbelow.

The baffling device 200 may include a housing, referred to herein as an elongated enclosure 202, having a first opening 204 located proximate a first longitudinal end 205 of the elongated enclosure 202 and in a first surface of the elongated enclosure 202. The elongated enclosure 202 may also include a second opening 206 located proximate a second longitudinal end 207, opposite the first longitudinal end 205, and in a surface of the elongated enclosure 202 different from which the first opening 204 is formed or located. The first and second openings 204 and 206 may be sized and configured to enable air to pass into and out of a cavity or passage within the elongated enclosure 202. Except for the first and second openings 204 and 206, the elongated enclosure 202 is substantially enclosed along the side and end surfaces thereof. Thus, while not specifically shown in FIG. 2, a wall or other structure is formed across the top of the elongated enclosure 202 to form cavities or passages further described hereinbelow.

The elongated enclosure 202 may be formed of any of a number of materials using any of a variety of manufacturing processes. For example, the elongated enclosure 202 may be made of metals, metal alloys, plastics, composites or other materials. Conventional processes may be used to manufacture the elongated enclosure 202 depending, at least in part, on the materials being used. Likewise, the first and second openings 204 and 206 may be formed using appropriate processes known in the art, depending, for example, on the types of materials used and the manufacturing processes employed to make the elongated enclosure 202.

Figure 3A:
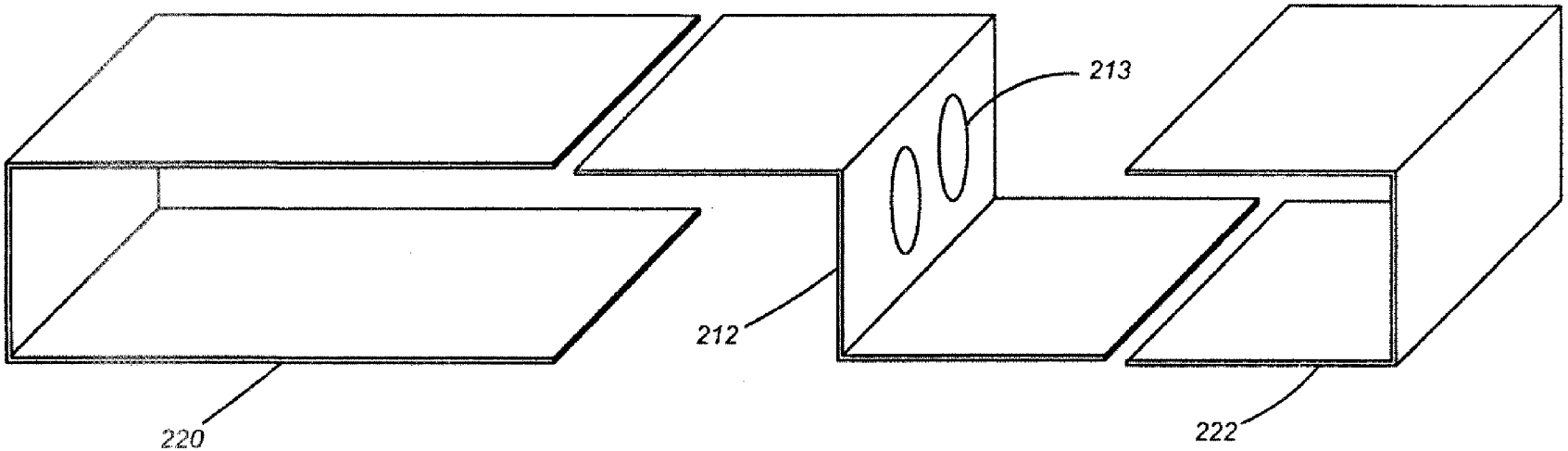
FIG. 3A is a perspective exploded view of a portion of the baffling device shown in FIG. 2.
Figure 3B:
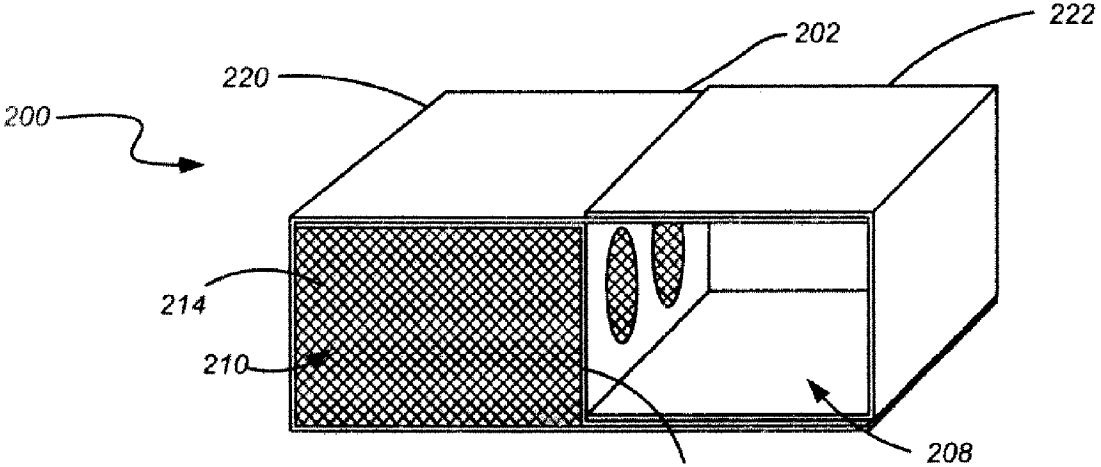
FIG. 3B is a perspective view of the portion of the baffling device shown in FIG. 3A in an assembled state.

Referring to FIGS. 3A and 3B, in conjunction with FIG. 2, a first chamber or channel 208 may be provided within the elongated enclosure 202. The first channel 208 may extend between the first opening 204 and the second opening 206. The first channel 208 may provide a path for a fluid, such as air, to move between the first and second openings 204 and 206. The first channel 208 may be sized and configured, in conjunction with the first and second openings 204 and 206, to enable a desired flow rate of air to pass therethrough. In one implementation, the first channel 208 is approximately half the width W of the elongated enclosure 202. However, those skilled in the art will recognize that various sizes and configurations are possible depending, for example, on the desired flow rate of air that is to be accommodated by the first channel 208.

A second chamber or channel 210 may also be provided within the elongated enclosure 202 at a location generally adjacent at least a portion the first channel 208. A perforated member 22 may be disposed between the first channel 208 and the second channel 210 and help to form the first and second channels 208 and 210. The perforated member 212 may enable sound waves that enter into the elongated enclosure 202 via the first or second openings 204 and 206 to pass from the first channel 208 into the second channel 210. In one embodiment, the perforated member 212 may include a screen-like structure having a desired amount of permissivity with regard to sound waves. In another embodiment, the perforated member 212 may include a substantially solid surface having a desired pattern of specifically sized and shaped perforations 213 formed therein. For example, in one specific embodiment, the perforations 213 may be substantially circular holes exhibiting a diameter of approximately 1 inch (25.4 millimeters) and spaced approximately 2 inches (50.8 millimeters) on center. Of course, such perforations 213 may exhibit other shapes and sizes as will be appreciated by those of ordinary skill in the art.

The second channel 210 may be partially or substantially entirely filled with an insulative material 214 (see FIG. 3B) to attenuate any sound waves that may be passing through the first channel 208. The insulative material 214 may include a material that absorbs or disperses sound waves passing through the elongated enclosure 202. For example, in one embodiment such insulative material 214 may include fiberglass insulation. In a more specific embodiment, the insulative material 214 may include fiberglass insulation having what is known as an "R-value" of approximately 19.

The second channel 210 may extend a desired length within the elongated enclosure 202 depending, for example, on the amount of sound attenuation desired and the amount and type of insulative material 214 being disposed therein. In one embodiment, the second channel 210 may extend approximately two-thirds (⅔) the length L of the elongated enclosure 202. In another embodiment, the second channel 210 may extend substantially the entire length L of the elongated enclosure 202 so long as the first and second openings 204 and 206 remain in substantially unrestricted communication with the first channel 208.

Referring more specifically to FIGS. 3A and 3B, the construction of an elongated enclosure 202 according to one embodiment is illustrated. FIG. 3A is an exploded view of various components of an elongated enclosure 202 and FIG. 3B is a perspective view of such components in an assembled state. It is noted that only a portion or a shortened section of the elongated enclosure 202 is shown in FIGS. 3A and 3B for convenience and clarity.

The elongated enclosure 202 may include a first enclosure member 220 and a second enclosure member 222. The first and second enclosure members 220 and 222 may each exhibit, for example, a cross-sectional geometry of a "C-channel." The first and second enclosure members 220 and 222 may be fastened together by appropriate means known in the art, such as, but not limited to, adhesives, mechanical fasteners (e.g., pop rivets or screws), welding, or other means as will be appreciated by those of ordinary skill in the art. A perforated member 212 may be provided and fastened between the first enclosure member 220 and the second enclosure member 222. In one embodiment, the perforated member 212 may exhibit a substantially Z-shaped cross-sectional geometry. In one embodiment, when configured to exhibit a Z-shaped geometry, perforated member 212 may include legs that each extend a distance equal to approximately half the width W of the elongated enclosure 202 (see FIG. 2). The perforated member 212 may be fastened to the first and second enclosure members 220 and 222 using similar means as discussed hereinabove.

The first enclosure member 220, perforated member 212 and second enclosure member 222 are assembled together to form the first channel 208 and the second channel 210 within the elongated enclosure 202 such as seen in FIG. 3B. As discussed previously, an insulating material 214 may be disposed in the second channel 210 to provide sound attenuation as desired.

Figure 4:
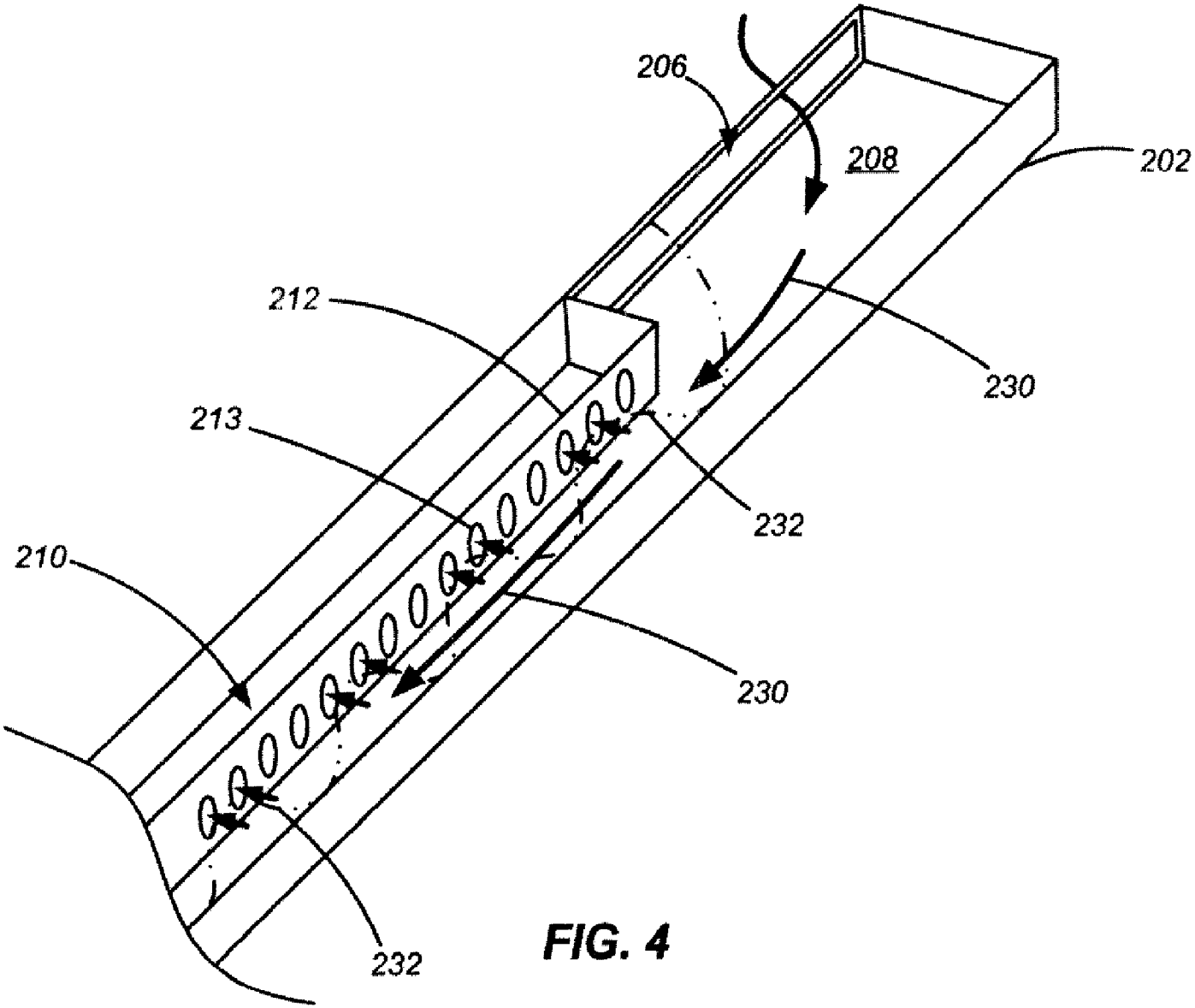
FIG. 4 is an enlarged view of a portion of the baffling device shown in FIG. 2.

Referring now to FIG. 4, an enlarged view of a portion of the elongated enclosure 202 is shown as indicated in FIG. 2. It is again noted that the upper surface (as viewed in FIGS. 2 and 4) has been removed for purposes of clarity and convenience in describing the construction and operation of the baffling device 200.

In operation, an air pressure differential may be formed between the first opening 204 (see FIG. 2) and the second opening 206 causing air (the airflow represented by arrows 230) to pass into the first channel 208. The air may flow relatively unimpeded through the first channel 208 and exit through the first opening 204. Additionally, the first and second openings 204 and 206 may enable sound waves to enter into the elongated enclosure 202 regardless of whether air is actively flowing through the first channel 208 or is relatively static.

As sound waves (represented generally by dashed line 232) pass into the first channel 208, they reflect or bounce between a surface of the elongated enclosure 202 (the surface also forming a part of the first channel 208) and the perforated member 212. The perforations 213 provided in the perforated member 212 enable the sound waves 232 (or at least a substantial portion of the sound waves) to pass into the second channel 210. The insulative material 214 (FIG. 3B) in the second channel 210 attenuates any sound waves 232 entering therein such that sound waves 232 entering the second opening 206 are substantially reduced in their intensity, if not completely dissipated, prior to reaching the first opening 204. Sound waves 232 not immediately dissipated within the insulative material 214 may further bounce off of one or more surfaces defining the second channel 210 and be further attenuated or dissipated by the insulative material 214. It is noted that while the sound waves 232 are shown as traveling from the second opening 206, through the elongated enclosure 202 toward the first opening 204, the sound waves 232 may enter from the first opening 204, travel through the first channel 208 towards the second opening 206, and likewise be attenuated in a similar manner as described above.

As will be appreciated by those of ordinary skill in the art, it is noted that baffling devices may exhibit different configurations than the example embodiments described hereinabove. For example instead of having one channel or passage to accommodate airflow, and a second channel or passage for purposes of sound attenuation, multiple channels may be used for either air passage, sound attenuation or multiple channels or passages may be used for each. For example, a first passage or channel configured for sound attenuation may be disposed between multiple channels configured to accommodate air passage. Likewise, an air passage channel may be disposed between multiple sound attenuation channels. In other embodiments, one type of passage or channel (e.g., sound attenuation) may be substantially surrounded by the other type of passage or channel (e.g., air passage).

A baffling device, such as described herein, may be used with movable partitions. For example, a baffling device may be associated with a dual-panel accordion-style folding partition to aid in the release of air from between the panels (e.g., during closing of the partition) while still maintaining, or even enhancing, the sound attenuation properties of the partition. Baffling devices may be placed in one or both of the panels of such a partition. Additionally, a baffling device may be installed at a variety of locations in such a partition. Examples of partitions with which such a device may be utilized include those described, for example, in U.S. Pat. No. 6,662,848, entitled AUTOMATIC DOOR AND METHOD OF OPERATING SAME and U.S. patent application Ser. No. 11/472,031 entitled HINGED CONNECTION, MOVABLE PARTITIONS USING SAME AND RELATED METHODS, the disclosures of each of which are incorporated by reference in their entireties.

Figure 5:
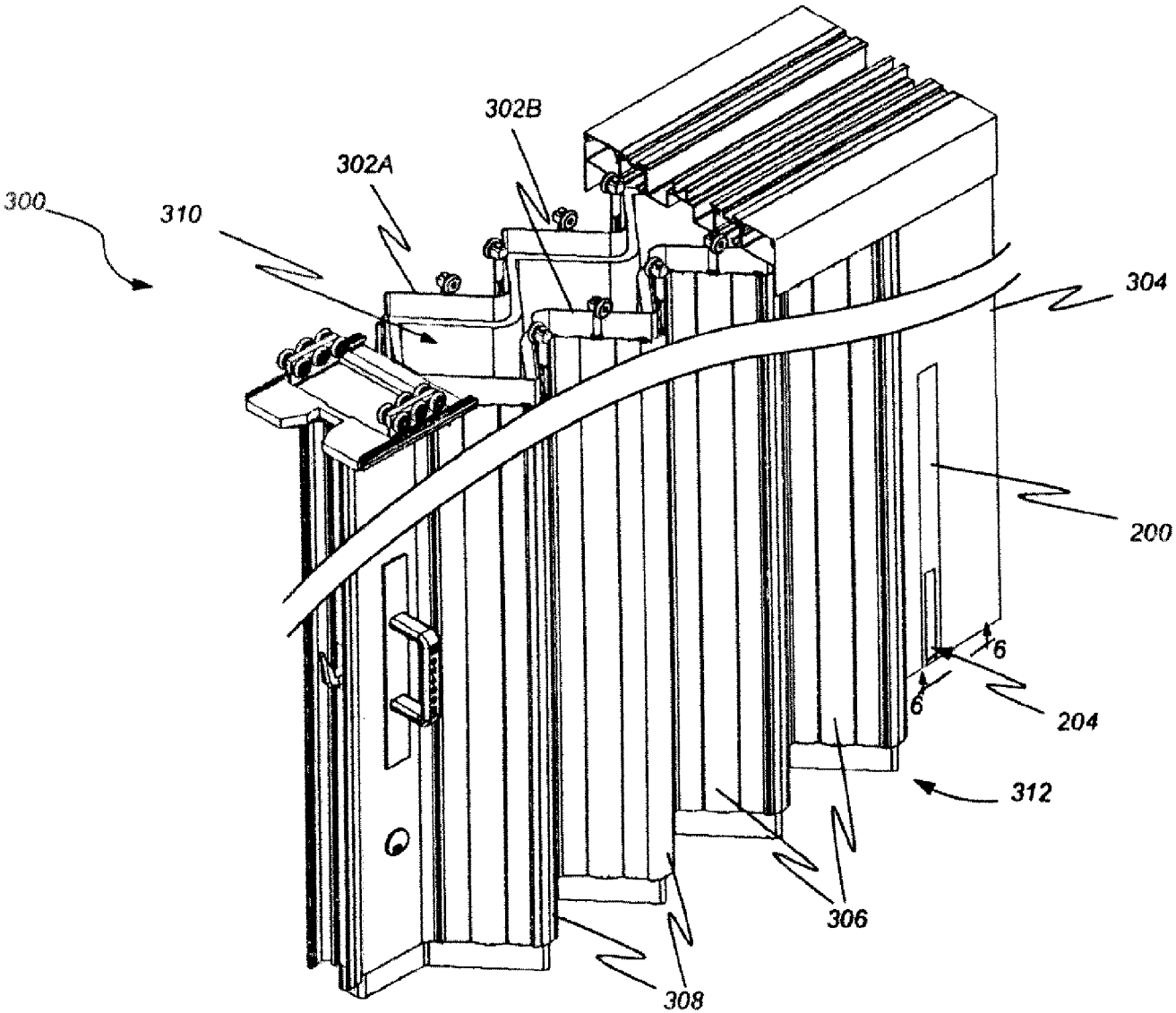
FIG. 5 is a perspective view of a dual-panel accordion folding partition incorporating a baffling device in a partition jamb in accordance with one embodiment of the present invention.

Referring to FIG. 5, a perspective view of a dual-panel accordion folding partition 300 having a baffling device 200 located in a portion of a jamb assembly according to one embodiment of the present invention is shown. The folding partition 300 may include two laterally spaced panels 302A and 302B extending from a jamb component 304. For example, the jamb component 304 may be a structure or member that couples the movable panels 302A and 302B to a doorjamb (not specifically shown). The jamb component 304 may be coupled to a fixed jamb or it may be coupled to a floating jamb as will be appreciated by those of ordinary skill in the art. Thus, the jamb component 304 may be located within a storage pocket associated with the partition 300 and will not necessarily extend therefrom when the partition 300 is in an extended position.

Each panel 302A and 302B of the partition 300 may include a plurality of panel sections 306 connected together with hinges 308 or other structures that enable adjacent panel sections 306 to fold or pivot relative to each other. The panels 302A and 302B may be disposed generally parallel to each other and laterally spaced from one another such that an air space 310 is located therebetween.

The baffling device 200 may be coupled with or disposed in, for example, a portion of the jamb component 304. The baffling device 200 may be constructed in a manner similar to that described above. In one embodiment, the baffling device 200 may extend substantially the height of the partition 300. In other embodiments, the baffling device 200 may extend only a partial height of the partition 300. The baffling device 200 may be located and oriented so that a first opening 204 is open or exposed to the environment outside the panel with which it is associated (e.g., panel 302A or 302B).

Figure 6:
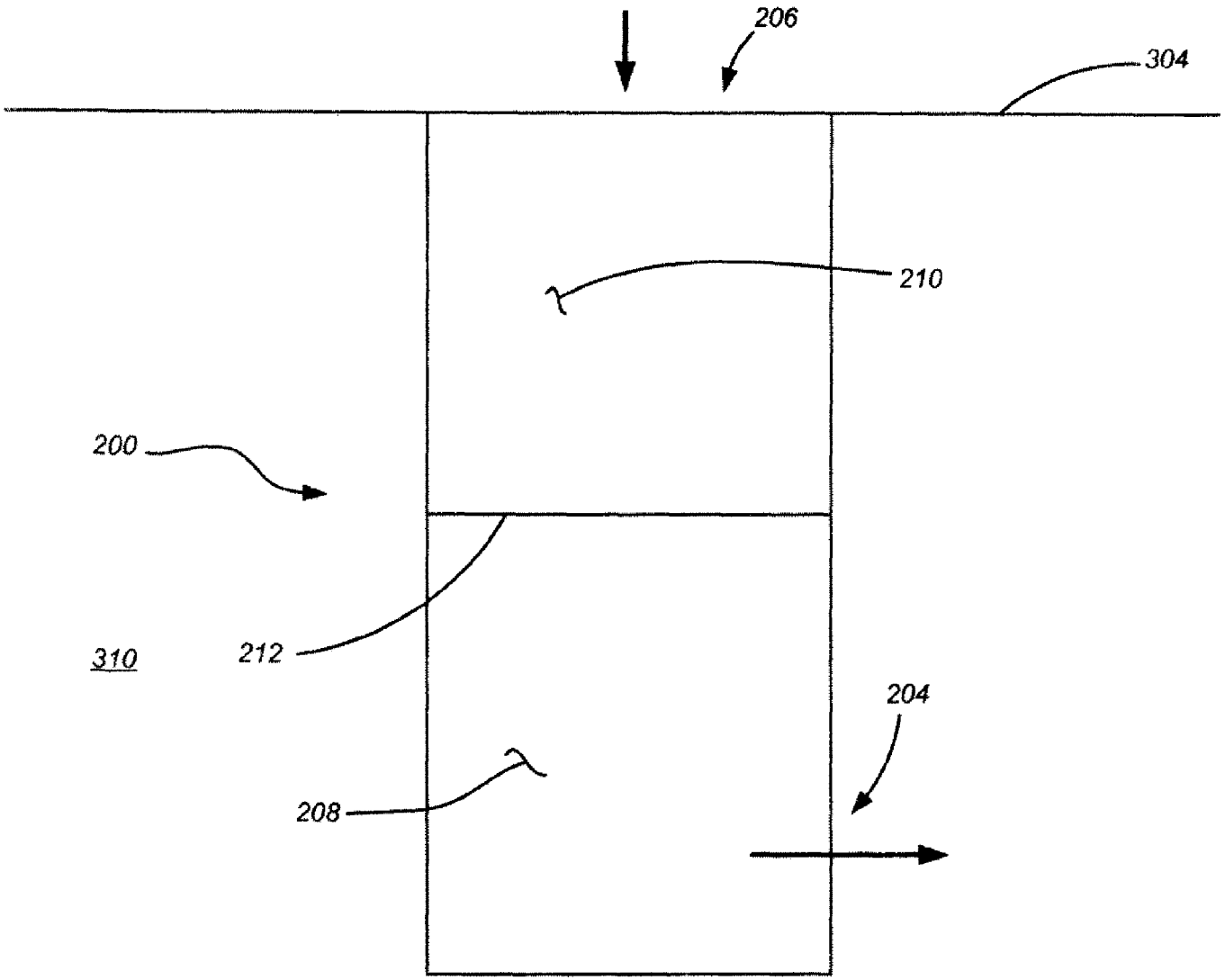
FIG. 6 is a cross-sectional view of a portion of the baffling device shown in FIG. 5.

Referring to FIG. 6 (which is a cross-sectional view of the baffling device 200 installed in the partition 300), in conjunction with FIG. 5, air may enter into the second opening 206 from the environment outside the partition 300 when the folding partition 300 is being extended (i.e., when it is being displaced from a stored state). The first opening 204 may be located within and exposed to the air space 310 between the panels 302A and 302B so that the air contained within the air space 310 may enter the first opening 204 of the baffling device 200 when the folding partition 300 is being retracted (i.e. compacted for storing).

It is noted that, although the baffling device 200 is shown in FIG. 5 as being installed and oriented such that the first opening 204 is proximate lower edge 312 of the partition 300, it will be apparent to those of skill in the art that the first opening 204 may be located proximate the upper edge of the partition 300, or at some other location.

When the folding partition 300 is closed (i.e., positioned in its extended or unfolded state) the baffling device 200 may help to maintain or even enhance the sound insulation or attenuation capabilities of the folding partition 300. For example, sound waves 232 passing through the second opening 206 may be reflected and forced to travel through the first channel 208 toward the first opening 204. As the sound waves 232 pass through the first channel 208, they may enter into the second channel 210 and be diffused or attenuated by any insulative material 214 (see FIG. 3B) disposed therein such as has been described hereinabove. It is noted that the first and second openings 204 and 206, in accordance with the presently described embodiment, are formed in substantially perpendicular surfaces of the baffling device 200. This provides additional sound attenuation by requiring any remaining sound waves 232 (i.e., any that have not been dispersed within the second channel 210) to exit the baffling device 200 in a direction that is at an angle relative to the direction in which the sound waves 232 enter the baffling device 200. In other words, to travel completely through the baffling device 200, a sound wave has to enter at a location in a first plane while traveling in a first direction, and exit at a location in a second plane (i.e., displaced from the location of the first plane) and while traveling in a second direction that is different from the first direction.

Figure 7:
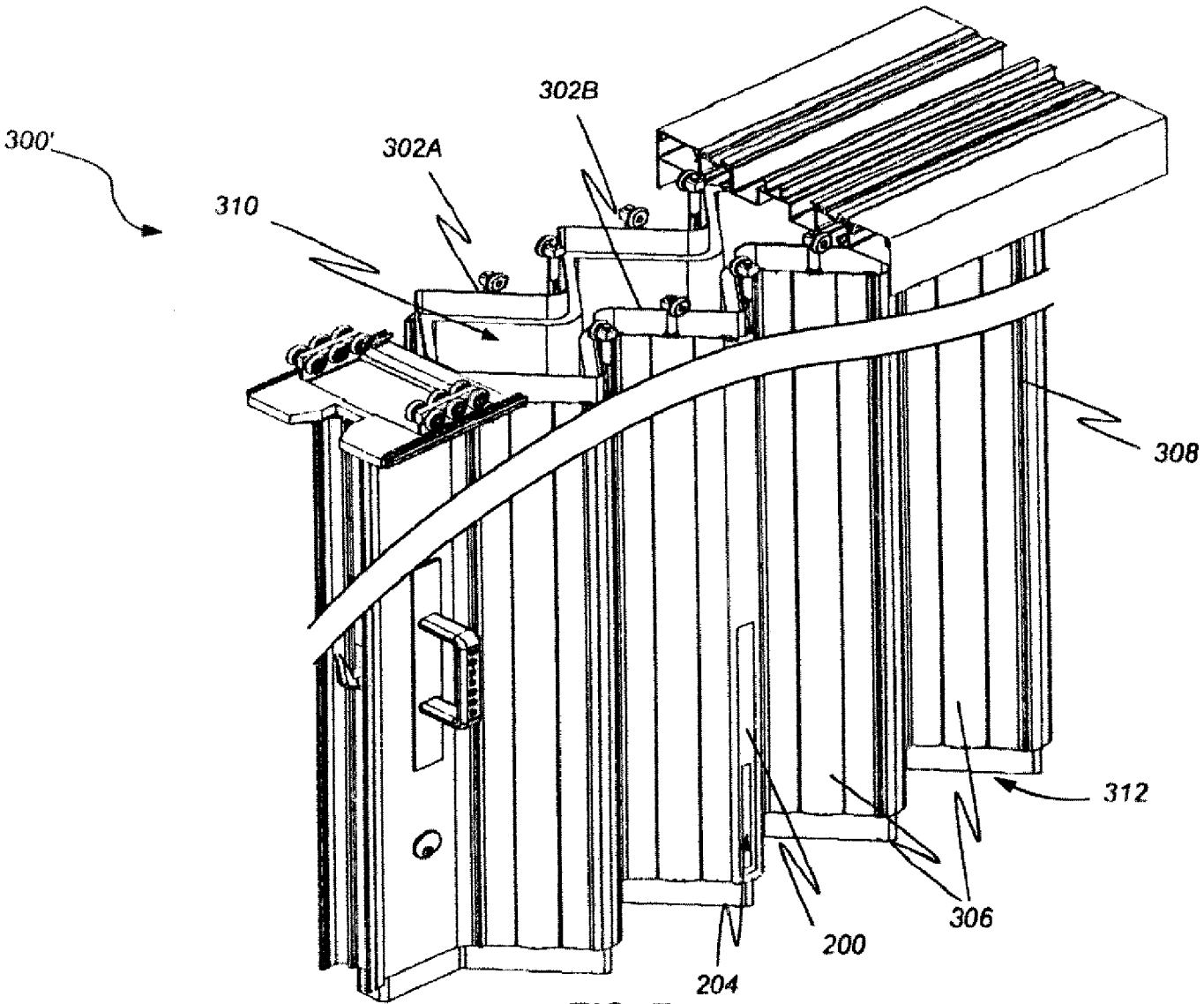
FIG. 7 is a perspective view of a dual-panel accordion folding partition incorporating a baffling device in a hinge structure according to an embodiment of the present invention.

Referring to FIG. 7, a perspective view of a dual-panel accordion-style folding partition 300' including baffling device 200 associated with a hinge member is shown in accordance with another embodiment of the present invention. The partition 300' may be configured generally similar to the partition 300 shown in FIG. 5, including panels 302A and 302B extending from a partition jamb (not shown). Each panel 302A, 302B may include a plurality of panel sections 306 connected together with hinges 308. The panels 302A and 302B may be laterally spaced from and parallel to each other providing air space 310 therebetween.

Figure 8:
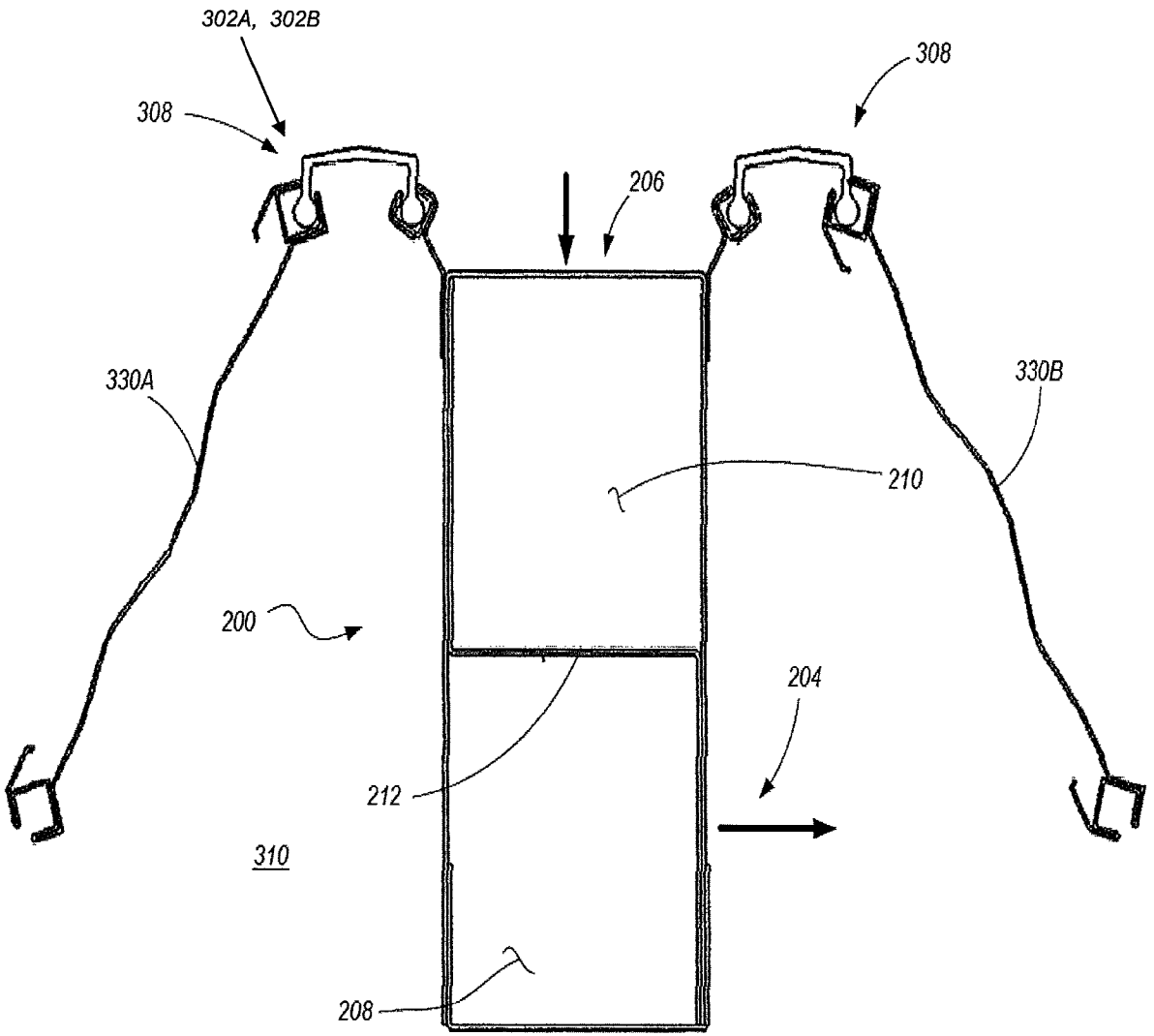
FIG. 8 is a cross-sectional view of an air release sound baffling device configured for disposition in a hinge structure according to an embodiment of the present invention.

Referring to FIG. 8 in conjunction with FIG. 7, the baffling device 200 may be formed in or otherwise associated with one or more hinges 308 in either or both of the panels 302A and 302B. The baffling device 200 may be located and oriented such that a second opening 206 is open or exposed to the environment outside the panel with which it is associated (e.g., panel 302A or 302B). Additionally, the baffling device 200 may be located and oriented such that the first opening 204 is open or exposed to the air space 310 between the two panels 302A and 302B. In one embodiment, the baffling device 200 may extend substantially the height of the hinge 308. In other embodiments, the baffling device 200 may extend only a partial height of the hinge 308.

As seen in FIG. 8 the baffling device 200 may be coupled with a first panel section 330A by way of a hinge 308 and with a second panel section 330B by way of a second hinge 308 coupled to an opposite second side. Thus, when the partition 300' is opening or closing, the panel sections 330A and 330B may pivot relative to the baffling device 200 enabling the panel sections 330A and 330B to collapse and extend, as would other panel sections hingedly coupled without a baffling device. In other words, the baffling device 200, when installed in association with a hinge 308, will not inhibit the ability of the partition 300' to either be stored in a compact state or deployed in an extended state.

While only a single baffling device 200 is shown in the embodiments described with respect to FIGS. 5 through 8, multiple baffling devices 200 may be utilized in a single partition 300 or 300'. For example, one or more baffling devices may be associated with a jamb component and one or more baffling devices may be associated with a hinged connection of panel sections in one or both of the panels in a folding partition. In another example, one or more baffling devices may be associated with hinged connections of the panel sections in a first panel (e.g., panel 302A) while one or more baffling devices are associated with hinged connections of the panel section in the second panel (e.g., panel 302B). In such a configuration, the baffling devices of the first panel may be longitudinally displaced relative to the baffling devices of the second panel when the partition is in an extended or closed condition. Thus, in such an embodiment, in order for a sound wave to travel through the baffling devices from one side of a deployed partition to another side thereof, sound traveling through a baffling device of the first panel will have to travel a longitudinal distance between the two panels in order to reach a baffling device in the second panel, and will then have to travel through the baffling device of the second panel.

Embodiments of the present invention clearly provide associated methods for releasing air from between two panels of a dual-panel folding partition (as well as drawing air into a space between dual panels of a folding partition) while also providing attenuation of sound waves.

While certain exemplary embodiments have been described and shown in the accompanying drawings, it is to be understood that such embodiments are merely illustrative of and not restrictive of the scope of the invention, and that this invention not be limited to the specific constructions and arrangements shown and described, since various other modifications are possible. Those skilled in the art will appreciate that various adaptations and modifications of the just described preferred embodiment can be configured without departing from the scope and spirit of the invention. Therefore, it is to be understood that, within the scope of the appended claims, the invention may be practiced other than as specifically described herein.

What is claimed is:

1. A folding partition comprising:

a first folding panel having a plurality of panel sections wherein each panel section is hingedly coupled with an adjacent panel section;

a second folding panel having a plurality of panel sections wherein each panel section is hingedly coupled with an adjacent panel section, the first folding panel and the second folding panel being laterally spaced from and substantially parallel to one another such that an airspace is located within the folding partition between the first folding panel and the second folding panel;

at least one baffling device disposed adjacent at least one panel section of at least one of the first folding panel and the second folding panel, the at least one baffling device including an elongated enclosure having a first opening to an environment outside the folding partition, a second opening to the airspace located within the folding partition between the first folding panel and the second folding panel, a flow path between the first opening and the second opening, and a sound attenuation chamber disposed within the elongated enclosure and adjacent to at least a portion of the flow path.

2. The folding partition of claim 1, wherein the at least one baffling device is associated with a jamb component of the folding partition.

3. The folding partition of claim 1, wherein the at least one baffling device is associated with a hinge member disposed between two adjacent panel sections of the first folding panel.

4. The folding partition of claim 1, wherein the first opening is exposed on a first side of the first folding panel and wherein the second opening is exposed on a second, opposing side of the first folding panel.

5. The folding partition of claim 4, further comprising a perforated member disposed between, and at least partially defining, the flow path and the sound attenuation chamber.

6. The folding partition claim 5, wherein the perforated member includes a plurality of substantially circular openings defined therein.

7. The folding partition of claim 6, wherein the plurality of substantially circular openings exhibits diameters of approximately one inch and are spaced relative to one another at approximately two inches on center.

8. The folding partition of claim 7, further comprising an insulative material disposed within the sound attenuation chamber.

9. The folding partition of claim 8, wherein the insulative material includes fiberglass insulation.

10. The folding partition of claim 4, wherein the first opening is formed in a first surface of the elongated enclosure and the second opening is formed in a second surface of the elongated enclosure.

11. The folding partition of claim 10, wherein the first surface and the second surface are oriented substantially perpendicular to one another.

12. The folding partition of claim 4, wherein the at least one baffling device includes at least a first baffling device associated with the first folding panel and at least a second baffling device associated with the second folding panel.

13. The folding partition of claim 12, wherein the at least a first baffling device and the at least a second baffling device are longitudinally spaced from one another.

14. The folding partition of claim 13, wherein the sound attenuation chamber of each baffling device includes an insulative material disposed therein.

15. A method of operating a foldable partition, the method comprising:

displacing a foldable partition from a substantially extended state to a substantially collapsed state, the foldable partition having a first panel with a plurality of hingedly coupled panel sections and a second panel with a plurality of hingedly coupled panel sections, the first panel and the second panel being laterally spaced from and substantially parallel to one another such that an airspace is located within the foldable partition between the first panel and the second panel; and flowing air from within the airspace between the first panel and the second panel into an opening of at least one baffling device, through a flow path adjacent to a sound attenuation chamber within the at least one baffling device, and out of an opening of the at least one baffling device to an environment outside of the foldable partition, while displacing the foldable partition from the substantially extended state to the substantially collapsed state.

16. The method according to claim 15, further comprising passing a sound wave through at least a portion of the flow path and into the sound attenuation chamber.

17. The method according to claim 16, wherein passing a sound wave through at least a portion of the flow path and into the sound attenuation chamber includes passing the sound wave through a perforated member disposed between and partially defining the flow path and the sound attenuation chamber.

18. The method according to claim 16, further comprising passing the sound wave into an insulative material disposed within the sound attenuation chamber.

19. The method according to claim 15, wherein associating at least one baffling device with the first panel includes disposing the at least one baffling device in a jamb component.

20. The method according to claim 15, wherein associating at least one baffling device with the first panel includes hingedly coupling the at least one baffling device with at least two panel sections of the first panel.

21. The method according to claim 15, further comprising associating at least one other baffling device with the second panel.

22. The method according to claim 21, further comprising longitudinally spacing the at least one baffling device from the at least one other baffling device.

* * * * *